United States Patent [19]

Rutten

[11] 4,106,252

[45] Aug. 15, 1978

[54] BUILDING STRUCTURE

[75] Inventor: Peter T. Rutten, Plainfield, Ill.

[73] Assignee: Railoc Company, Inc., Plainfield, Ill.

[21] Appl. No.: 763,109

[22] Filed: Jan. 27, 1977

[51] Int. Cl.[2] ..... E04D 3/00; E04B 7/00

[52] U.S. Cl. ..... 52/762; 52/82; 52/466

[58] Field of Search ..... 52/82, 465, 466, 467, 52/468, 496, 498, 499, 584, 461–463, 80, 464, 493, 710, 469, 459–460

[56] References Cited

U.S. PATENT DOCUMENTS

| | | | |
|---|---|---|---|
| 1,693,046 | 11/1928 | Nelson | 52/463 |
| 1,957,933 | 5/1934 | Brandl | 52/467 |
| 2,151,239 | 3/1939 | Rutten | 52/82 |
| 2,328,197 | 8/1943 | Cowin | 52/464 |
| 2,328,197 | 8/1943 | Cowin | 52/464 |
| 2,747,703 | 5/1956 | Broberg | 52/464 |
| 3,002,591 | 10/1961 | Hess | 52/493 |
| 3,232,395 | 2/1966 | La Barge | 52/461 |
| 3,367,077 | 2/1968 | Johnston | 52/499 |

FOREIGN PATENT DOCUMENTS

| | | | |
|---|---|---|---|
| 1,509,578 | 12/1967 | France | 52/466 |
| 861,026 | 2/1961 | United Kingdom | 52/463 |

*Primary Examiner*—John E. Murtagh

*Attorney, Agent, or Firm*—Olson, Trexler, Wolters, Bushnell & Fosse, Ltd.

[57] ABSTRACT

A building structure is disclosed comprising a plurality of rib members and a plurality of panel members. The rib members comprise metal extrusions which are adapted to effect interconnection of said panel members to form structures such as roofs for silos, tanks, barns and other buildings, or alternately to define wall partitions or the like. Also provided is a wedge member adapted to be attached to the rib member by a bolt or the like for securing the panel members to the rib member.

3 Claims, 9 Drawing Figures

BUILDING STRUCTURE

BACKGROUND AND OBJECTS OF THE INVENTION

The present invention relates generally to building structures and, more particularly, to a building structure comprising a plurality of panels and a plurality of ribs adapted to attach the panels to form roofs, walls and the like. The disclosure will be facilitated, however, by directing it particularly to the problem of providing a structure to be employed as a silo roof.

Silo roof structures known in the prior art are usually made of sheet metal with a plurality of cooperating segments or panels of sheet metal having their edges formed to interlock with each other. The edges are curled or formed into male and female rib configurations to interlock with corresponding ribs on adjacent segments. In order to obtain the necessary curvature to form the customary dome shape of a silo roof, it is necessary to preform all of these segments to a definite curvature so that they may be interlocked by sliding the ribs of one panel into the ribs of the adjacent panel. Consequently, it is often difficult to construct a roof using such panels when there are even slight variations in their curvatures. Also it is difficult and expensive to crate and ship such panels in such a manner that the curvature will be maintained. Furthermore, it is also necessary to use special machinery in order to form these panels as the edges thereof must be of differing shape, one edge providing the female element of the joint, the other the male portion. In this type of construction, relatively heavy gauge material had to be used in order to provide sufficient overall strength, or alternately separate rafter structures had to be provided.

Other structures for roofs, walls and the like are also known comprising rib, rafter or stud members and panel or sheet members. However, a major problem with many of these structures has been that they utilize a plurality of parts including extrusions, holding clamps, bolts and the like so that they are difficult for the unskilled laborer to construct. Also, specifically in reference to the construction of silo roofs, it has usually been necessary with known structures to employ several laborers to fit the ribs and panels thereof together, one or more working on the outer side and one or more on the inner side of the structure.

It is an object of the present invention to provide a building structure particularly applicable to be used as a roof for a silo, which can be erected with relatively unskilled laborers, and with necessity of employing laborers interiorly of the silo, only.

Another object of the present invention is to provide a building structure which comprises a relatively small number of parts so that it is relatively simple and inexpensive to manufacture.

It is a further object of the present invention to provide a building structure in accordance with the foregoing objects which include rib members and panel members of relatively light weight to facilitate the erection thereof with a minimum of labor.

It is a still further object of the present invention to provide a building structure in accordance with the foregoing objects which effectively forms a waterproof closure having great strength and rigidity.

SUMMARY OF THE INVENTION

Briefly, the present invention includes a rib or rafter member, a panel member and a plurality of wedge and bolt members for securing a plurality of such panel members to a plurality of such rib members. The rib member comprises a metal extrusion having, in a preferred embodiment, an upper channel and a lower channel with a slot joining the channels. The panel members comprise sheets of light gauge metal cut in wedges to form segments of a dome-shaped silo roof. The wedges or segments each have edges formed in a reverse bend or a curl in order to slide said edges into the upper channel of the extrusion. The segments are then held in place upon the extrusion by a carriage bolt, a wedge and a nut. The head of the bolt may be slid into place in the lower channel from the interior of the roof with said bolt being held against rotation by the slot. The wedge is provided with an opening to receive the threaded end of the carriage bolt, and the nut is tightened thereon to force the wedge down into the upper channel to secure the panels to said rib or rafter members. In the case where a silo roof is being constructed, the extrusion will, of course, have a generally curved or arcuate shape to conform to the shape of a frame for a generally dome-shaped silo roof. The sheet metal panels, however, need not be so curved as they are of a relatively light gauge and will automatically assume the proper curvature of segments of a dome when the assembly is completed. The extrusions thus function to join and form the roof panels and provide rafters for the support of the roof structure. The wedge and bolt members are utilized to maintain the assembled relation of the panels and extrusions.

In a second embodiment, an extrusion is used which has only a single channel formed therein to receive the curled edges of the panels. In this embodiment an extrusion has but a single channel and a series of square apertures formed therein to receive the carriage bolts which then must be mounted from the opposite side thereof, i.e. the silo exterior. These bolts cooperate with similar wedges to maintain the assembled relation of the panels and the extrusions.

Other objects and advantages of the present invention will become apparent from the following detailed description and the accompanying drawings wherein like reference numerals throughout the various views are intended to designate similar elements or components

DETAILED DESCRIPTION

A first embodiment of the structure of the present invention is shown in FIGS. 1-6 of the drawings in conjunction with a silo roof. An upper portion of a circular silo wall 20 of known construction is shown, wherein a series of reinforcing hoops 22 encircle the wall 20, with only the hoop 22 immediately below the upper edge thereof being illustrated. The hoop 22 is of known construction and is attached to the wall 20 by known clamping or connection means.

Figure 1:
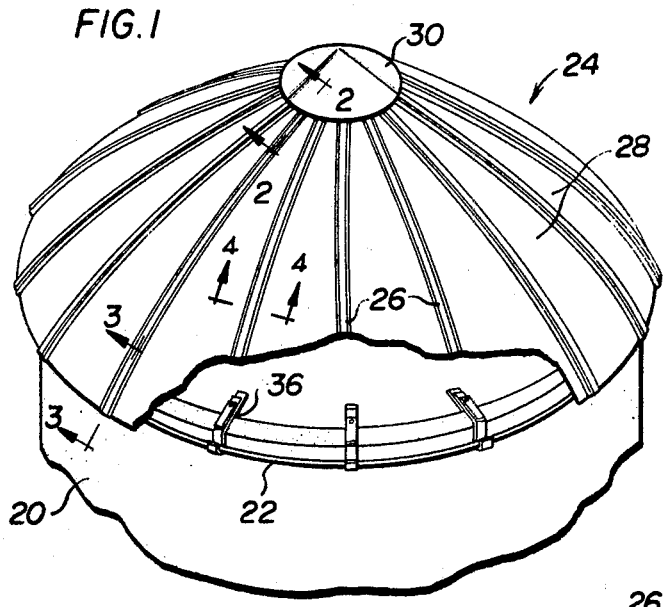
FIG. 1 is a perspective view of a silo with a roof structure incorporating features of the present invention.
Figure 2:
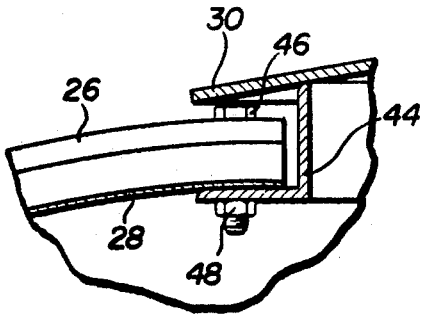
FIG. 2 is a section of a view along line 2—2 of FIG. 1 showing additional detail thereof.

The building structure 24 of the present invention is utilized to form the silo roof as shown in FIG. 1 with a portion thereof cut away. The structure 24 of the present invention is made up of a plurality of elongate, generally arcuate or curved shaped ribs 26 which function as studs or rafters, and a series of panel or sheet members 28 interconnected by said rafters 26 to form the silo roof 24. A cap 30 of known construction is attached to form a top portion of the roof 24 and complete the enclosure.

Figure 3:
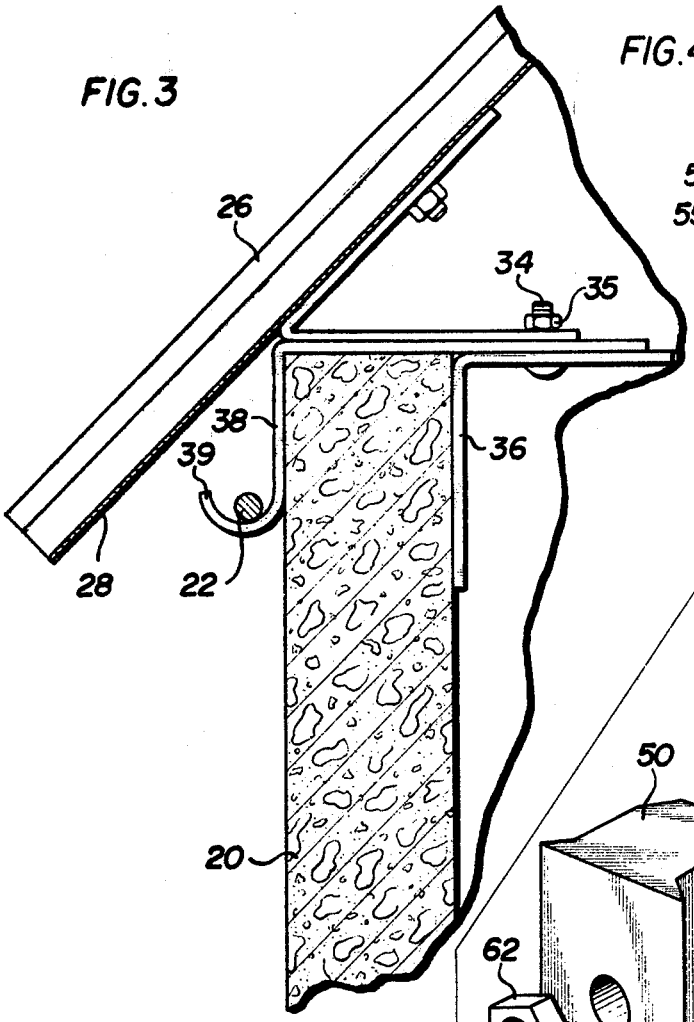
FIG. 3 is a sectional view along line 3—3 of FIG. 1 showing additional detail thereof.

The arcuate ribs 26 have their lower ends located in circumferentially spaced relation to the outer side of the wall 20 just below the top thereof, and are attached to the reinforcing hoop 22 as best seen in FIG. 3. Each rib 26 is attached by a bolt 31 and a nut 33 to one side of a generally "V" shaped bracket 32 which is in turn attached on its other side by bolt 34 and nut 35 to one leg of each of two "L" shaped brackets 36 and 38. Brackets 36 and 38 have their opposite legs disposed adjacent the inner and outer periphery of silo wall 20, respectively. Bracket 38 is provided with a "J" end portion 39 which engages hoop 22. The ribs are also held in circumferentially spaced relation at their upper end by an assembly ring 44 to which each rib 26 is attached by suitable means such as bolt 46 which passes through openings provided therefore in the rib 26 and the assembly ring 44 and is secured thereto by nut 48. The assembly ring 44 forms an opening at the top of the silo roof 24, which is covered by the cap member 30.

Figure 4:
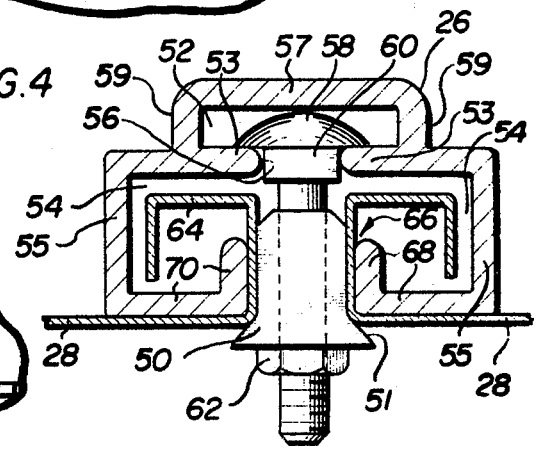
FIG. 4 is a sectional view along line 4—4 of FIG. 1 showing additional detail according to a preferred embodiment of the present invention.
Figure 5:
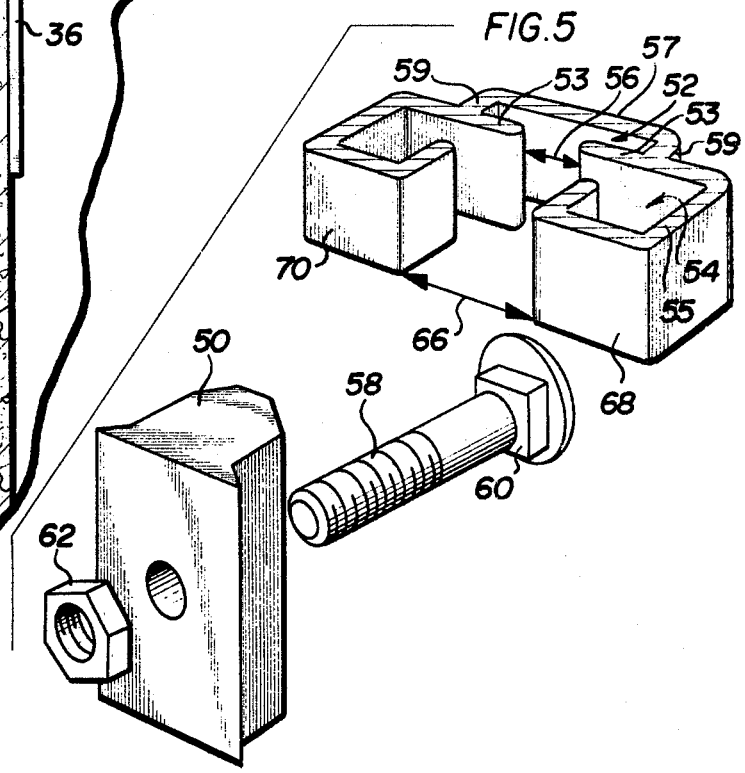
FIG. 5 is an exploded perspective view of elements of FIG. 4.
Figure 6:
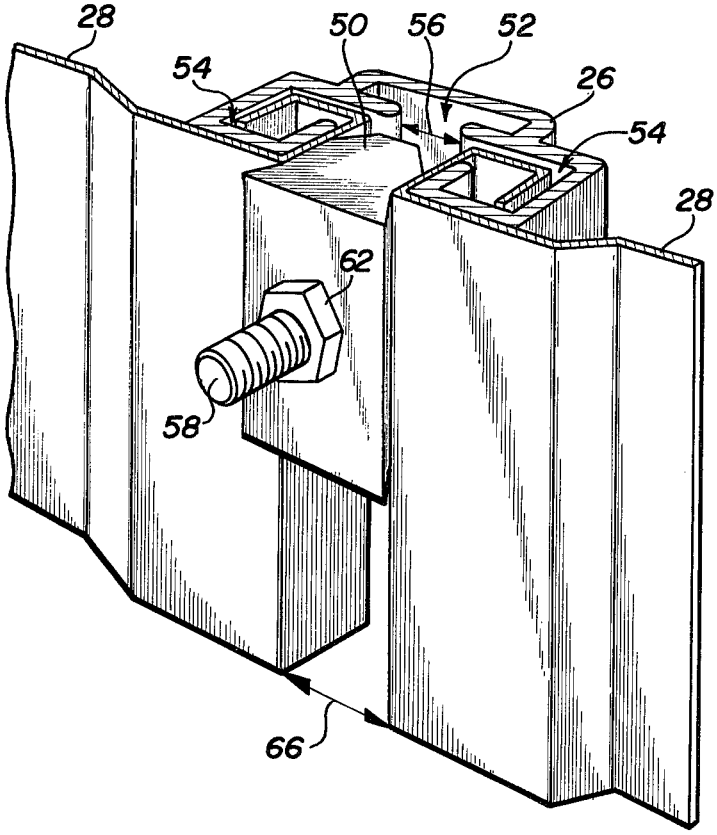
FIG. 6 is a perspective view showing elements of a structure incorporating features of the present invention.

In a preferred embodiment, the ribs or rafters 26 comprise metal extrusions, preferably of aluminum, and configured as best seen in FIGS. 4, 5 and 6. Viewing the rafter 26 in section, it can be seen that said rafter extrusion has a lower channel 52 and an upper channel 54 formed therein. The channels 52 and 54 extend the length of the rafter member 26 and are in effect formed by a series of interconnected wall and bracket portions. More specifically the upper channel 54 is defined by a base or intermediate wall portion 53 having a pair of spaced side wall portions 55 extending therefrom extending in facing relation from said side wall portions 55, are a pair of L-shaped wall members or portions 68 and 70, the edges of which are turned inwardly relative to the channel 54 to define an opening 66. The lower channel 52 is defined by a U-shaped wall portion 57 having the edges 59 thereof joined or formed integral with the base wall 53. An elongate slot 56 is formed in said base wall 53 to provide for communication between the respective channels 52 and 54. The L-shaped bracket or wall members 68 and 70 cooperate with the edges of the panel or sheet members 28 whose edges are provided with complimentary bend or curves 64 for engagement in the channel 54.

The panel or sheet members are preferably of a relatively light gauge metal construction and accordingly may be curved or formed as the roof structure is erected, to form segments of a dome. As the sheets are made, therefore, it will not be necessary to impart this curvature to them, as the arcuate curvature and subsequent placement of the rib or extrusion members 26 will cause the sheets 28 to assume the proper curvature after being applied thereto. Of course, the panels 28 may be preformed to a slight curvature, if desired.

The sheets 28 are applied to the rafter members or extrusions 26 by sliding their curved edges 64 into the complimentary channels 54 provided therefore in the extrusion 26, to form the completed roof structure 24 to be attached to the top of the silo wall 20 as already described. Whether the panels 28 are flat or preformed to a slight curvature, they will assume the curvature of the rafters 26 upon assembly.

After the sheets 28 have been so inserted into the channels 54, wedge members 50 and bolt 58 members are applied thereto to maintain the assembled relation of the panels 28 and extrusions 26. In a preferrred embodiment, bolt members 58 are what is termed in the art "carriage bolts", in that a square or non-circular portion 60 is provided adjacent the head thereof. The bolts 58 are assembled from the exterior of the structure and are slid through the opening 56 between the channels 52 and 54 of the extrusion 26 to the desired position for the location of the respective wedge members 50. In this regard, as shown in FIG. 4 the head of bolt 58 extends into the lower channel 52 and is held therein by the intermedial wall 53, while the square portion 60 of the bolt 58 is disposed in slot 56, with the edges thereof engaging said square portion 60 to hold the entire bolt 58 against rotation relative to the rafter 26. The wedge 50 is provided with an opening to receive the threaded end of the bolt 58 and nut 62 is then tightened upon bolt 58 to force the wedge 50 down into the opening 66 in the upper channel to secure the respective panel 28 firmly in place. It will be noted that the wedge 50 is of a suitable width to force the edges of the panels 28 against the L portions 68 and 70 of the channel 54. In addition, wedge 50 is provided with end flanges 51 which are tapered to assure firm engagement and also function as stops to determine the final position of the wedge 50 relative to extrusion 26. According to the present invention, a plurality of bolts 58 and wedges 50 are utilized along the length of any given rib or rafter extrusion 26 to maintain the assembled relation of the panels 28 thereto as dictated by the length thereof.

It is believed clear from the foregoing description that entire silo roof structure 24 may be assembled according to the present invention from the inside or interior of the structure. Further, because of the relatively uncomplicated method of assembly and relatively light weight of the parts utilized, said structure may be assembled by a minimum number of relatively unskilled laborers. All of the above functions provide the present invention with an economic advantage over prior art structures.

Figure 7:
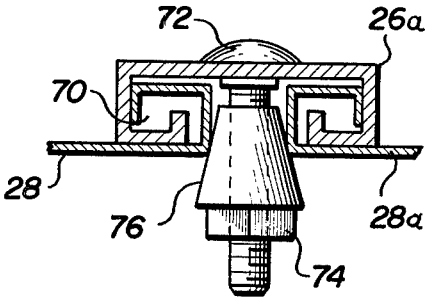
FIG. 7 is a sectional view similar to FIG. 4 illustrating a second embodiment of a structure according to the present invention.
Figure 8:
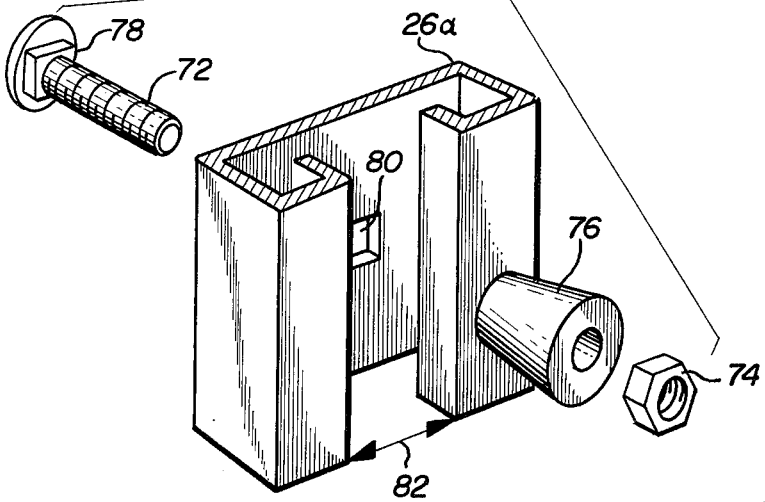
FIG. 8 is an exploded perspective view of elements of FIG. 7.
Figure 9:
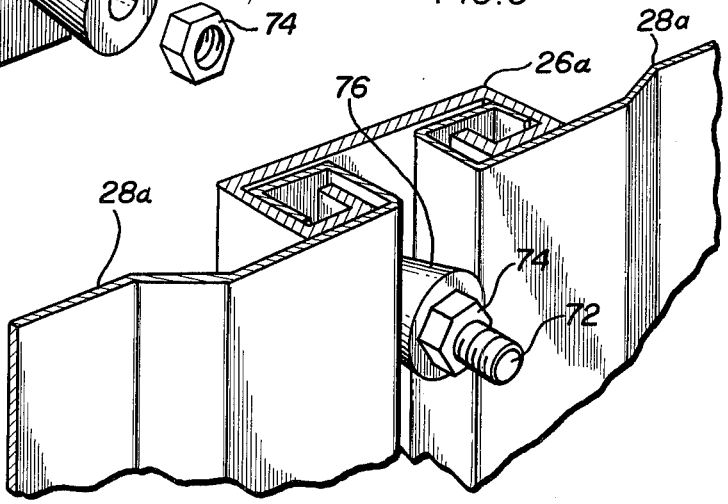
FIG. 9 is a perspective view of FIG. 7.

Referring now to FIGS. 7, 8 and 9, a second embodiment 26*a* of a rib or rafter extrusion is illustrated. In this embodiment the extrusion 26*a* includes a single channel 70, having the same form as the upper channel 54 of the first embodiment. The panels or sheets 28*a* are slidably mounted in the channel 70 and cooperate therewith in the same manner as the sheets 28 of the first embodiment. A carriage bolt 72, with nut 74 and wedge 76 adapted to fit thereon are provided similar to the corresponding parts in the first embodiment.

As best seen in FIG. 8, the extrusion 26*a* is provided with a square opening 80 therein to receive the square portion 78 of the carriage bolt 72. The wedge 76 has an opening for receiving the end of carriage bolt 72 and, similar to the first embodiment, the nut 74 is used to drive the wedge into the opening 82 of the channel 70 to secure the panels 28a thereto and maintain the assembled relation of the panels and extrusions. Also, as in the first embodiment, a plurality of bolts 72, openings 80, wedges 76 and nuts 74 are used along the length of a given rafter extrusion 26*a*, as required to secure the panels or sheets 28*a* thereto. It is obvious that in this embodiment, another worker will be required to insert a bolt 72 into the openings provided therefore 80 from the opposite side of the structure.

Thus, the extrusions 26 and 26*a* perform multiple functions, serving to hold the panels 28 and 28*a* together, form the panels 28 and 28*a* to the proper shape to form a dome-shaped silo roof structure, and act as rafters to provide a rigid support for the structure, thereby making the structure self-supporting. Also, in the first embodiment, the structure is completely weather-proof due to the method of securing the individual sheets 28 to the extrusions 26, and due to the formation of the extrusions 26 which have no openings whatsoever therein communicating with the inside of the structure. The extrusions 26 further give a smooth and attractive exterior appearance to the assembled silo roof, while also serving to protect nuts 58, bolts 62, and wedges 60 against rust and corrosion.

While the invention has been described in connection with a preferred embodiment, it will be understood that it is not intended to limit the invention thereto, but it is intended to cover all modifications and alternative constructions falling within the spirit and scope of the invention as expressed in the specification and the appended claims.

The invention is claimed as follows:

1. A joint construction for joining at least two adjacent panel members of a building roof construction or the like, to provide a substantially waterproof joint between said panels, which joint can be assembled from the interior of said construction, said joint construction comprising: at least two panel members having edges formed to reverse a bent configuration; a rigid rafter member receiving said reverse bent edges; and holding means for maintaining said edges in assembled relation with said rafters; said rafter member including a first elongate channel extending the length thereof for receiving said panel edges, said channel being defined by an intermediate wall section, a pair of spaced side walls, and L-shaped end wall sections extending from said side walls in facing relation, and having the free ends thereof spaced apart and disposed substantially parallel to each other to define an elongate opening through which said panel edge portions extend into said first channel, a second channel provided by an elongate, generally U-shaped wall portion formed integral with said intermediate wall to provide a fully enclosed second channel, and elongate passage means formed in said intermediate wall interconnecting said first channel and said second channel; said holding means comprising a plurality of bolt and nut assemblies, with each bolt including an enlarged head portion disposed in said channel, and a polygonal shaped portion engaged in said elongate passage means, and a threaded end to which said nut is engaged extending through said first channel and outwardly of said opening, and wedge member engaged over each said bolt and drawn interiorly of said first channel to force and maintain said reverse bent edge portion in engagement with the free ends of said L-shaped end wall sections said rafter member, said rafter being disposable exteriorly of said roof construction, with the integral nature of said U-shaped section providing a substantially waterproof joint with said nut and bolt assemblies and said wedge members housed within said rafter member.

2. A joint construction according to claim 1, wherein said end walls defining said first channel include edges turned inwardly of said first channel to provide elongate surface means against which said reverse bent panel edges are forced into wedged engagement by said wedge member.

3. A joint construction according to claim 1, wherein said rafter member is a metal extrusion.

* * * * *